United States Patent [19]

Hamant et al.

[11] Patent Number: 4,757,985

[45] Date of Patent: Jul. 19, 1988

[54] DEVICE FOR UNSTACKING FLAT OBJECTS

[75] Inventors: Jean-Pierre Hamant, Valence; Michel Chaudy, Etoile sur Rhone; Philippe Jeantin, Valence; Laurent Pellegrin, Livron sur Drome, all of France

[73] Assignee: Compagnie General d'Automatisme CGA-HBS, Paris, France

[21] Appl. No.: 71,125

[22] Filed: Jul. 8, 1987

[30] Foreign Application Priority Data

Jul. 9, 1986 [FR] France ..... 86 10007

[51] Int. Cl.[4] ..... B65H 3/08

[52] U.S. Cl. ..... 271/31.1; 271/146; 271/149; 271/155

[58] Field of Search ..... 271/31.1, 146, 149–151, 271/154, 155

[56] References Cited

U.S. PATENT DOCUMENTS 2,191,586 2/1940 Richard .
3,035,834 5/1962 Bottrell ..... 271/149 X
3,966,193 6/1976 Storace ..... 271/150
3,995,851 12/1976 Casper .
4,183,517 1/1980 Hageman et al. .
4,295,645 10/1981 Nahar et al. .
4,299,379 11/1981 Preston ..... 271/149 X
4,621,798 11/1986 Akers ..... 271/31.1 X

*Primary Examiner*—Richard A. Schacher
*Attorney, Agent, or Firm*—Sughrue, Mion, Zinn, Macpeak and Seas

[57] ABSTRACT

An unstacking device for objects such as mail envelopes is of the type comprising a magazine for storing and feeding stacked objects and a discharge head for separately removing jogged objects from a stack. The device is provided within the terminal portion of the magazine with a transition edge guide which serves to restore inclined objects to a practically upright position for subsequent discharge and is inclined with respect to the direction of feed motion of stacked objects and with a jogging reference edge guide which is relatively displaced towards the exterior of the magazine. There are associated with the edge guides a feed screw for advancing objects and a delay screw for retarding objects, the screws being interposed between jogging rollers opposite to the edge guides.

10 Claims, 4 Drawing Sheets

DEVICE FOR UNSTACKING FLAT OBJECTS

BACKGROUND OF THE INVENTION

1. Field of the Invention

This invention is concerned with unstacking of flat objects with a view to removing them one by one from a stack and carrying out unitary distribution of such objects.

The flat objects considered may in particular be pieces of mail such as envelopes.

An unstacking device permits automatic feeding of a machine for indexing, re-addressing and/or sorting pieces of mail.

2. Description of the Prior Art

In accordance with known practice, a device for unstacking flat objects such as pieces of mail or envelopes essentially comprises a magazine for storing envelopes in a stack and a discharge head located at the end of a magazine. The discharge head is provided with means for suction and transfer of the end envelope of the stack. The magazine itself is equipped with means for displacing the stacked objects towards the discharge head and means for suitable presentation of the end envelope in front of the discharge head.

By way of example, the discharge head can consist of a suction cup subjected to a rocking movement which advantageously takes place on a forward and return path of travel as well as to a back-and-forth movement of translation, an abutment member being associated with the suction cup for the abutting application of the end envelope before this latter is removed from the stack. The discharge head can also consist of a wall having suction orifices and associated with a drum for accelerating the envelope. Said head can also consist of a conveyor-belt or an accelerating suction drum.

The means with which the storage magazine is equipped for ensuring suitable presentation of objects opposite to the discharge head are expected to satisfy many requirements, particularly in regard to the constraints imposed when processing pieces of mail having characteristics which may be very different from each other. Among the constraints which are to be taken into account, the following are in fact worthy of mention:

disparity both in weight and in size of the envelopes of a batch to be processed;

disparity in the characteristics of mail material which can be of paper or of plastic, for example, and results in pieces of mail such as envelopes having surfaces which may be rough, porous, glossy or very smooth;

disparity in constitution or consistency of mail envelopes and the like which can range from a single folded sheet having sealing points or a simple reply card to lined envelopes or documents mailed in band-type wrappers or in wrapping and/or addressing film.

It must consequently be ensured that, as the pieces of mail such as envelopes advance towards the discharge head, the means for presenting the envelopes in front of the head must carry out in particular lateral jogging of the envelopes which have to be aligned on one of their edges at least in the terminal zone of the stack as well as separation of the envelopes from each other in the same terminal zone. This enables the discharge head to perform reliable and correct gripping of the end envelope but of this envelope alone irrespective of the characteristics of the end envelope and those of the envelopes which follow.

The presentation system can comprise a joggable lateral edge guide on the magazine and sets of rollers which are mounted in the bottom wall of the magazine and driven in rotation so as to thrust the envelopes against the joggable lateral edge guide. Said presentation system can also be provided with means for blowing air jets onto the free edges of the envelopes, in particular the top edges of said envelopes, in order to separate the envelopes in the terminal zone of the stack and/or to retain the envelope which follows the end envelope to be withdrawn from the stack.

In order to improve the presentation of envelopes in front of the discharge head and to facilitate withdrawal of the end envelope alone, the magazine can also be equipped with means for tilting the envelopes in its terminal zone so that the end envelope arrives with its bottom edge foremost against the abutment member or the suction wall of the discharge head. These last-mentioned means can be constituted by a set of motor-driven belts or a blowing ramp which produces action on the bottom edges of the envelopes in said terminal zone.

This system for the presentation of objects and especially pieces of mail such as envelopes in front of the discharge head fails to produce consistent action on the different envelopes of a batch to be processed and results in performances which remain insufficient when the envelopes to be processed have a particularly broad spectrum of characteristics.

The aim of the present invention is to provide a device for unstacking objects which may have very different characteristics with respect to each other. By making use of simple means providing highly reliable operation, the device in accordance with the invention permits the achievement of particularly enhanced performances.

SUMMARY OF THE INVENTION

This invention is concerned with a device for unstacking flat objects, comprising a magazine for receiving stacked objects, a discharge head located at the end of the magazine, feed means for advancing said stacked objects in the magazine towards the discharge head, and further comprising in the terminal portion of the magazine opposite to the discharge head a lateral edge guide and associated rollers for jogging objects and means for separating said objects which are present in front of the discharge head.

A distinctive feature of the invention lies in the fact that the jogging edge guide considered from the upstream end to the downstream end on said terminal portion of the magazine is constituted by a first edge guide designated as a transition and object-position resetting edge guide which is placed in an inclined position with respect to the direction of feed motion of said objects towards said discharge head and by a second edge guide which provides a jogging reference with respect to the discharge head and is substantially parallel to the direction of feed motion of the objects towards said head, said jogging reference edge guide being relatively displaced towards the exterior of the magazine with respect to said transition and position-resetting edge guide.

Another distinctive feature of the invention lies in the fact that an object-advancing feed screw and an object-retarding delay screw are interposed between the jogging rollers with which they are associated opposite to the transition and position-resetting edge guide and the jogging reference edge guide.

In particular, the transition and position-resetting edge guide has an increasing angle of slope from the upstream end to the downstream end, the top edge of the terminal portion of said guide being more steeply inclined than its bottom edge.

BRIEF DESCRIPTION OF THE DRAWINGS

The features and advantages of the invention will become more readily apparent from the following detailed description and accompanying drawings, in which.

Figure 1:
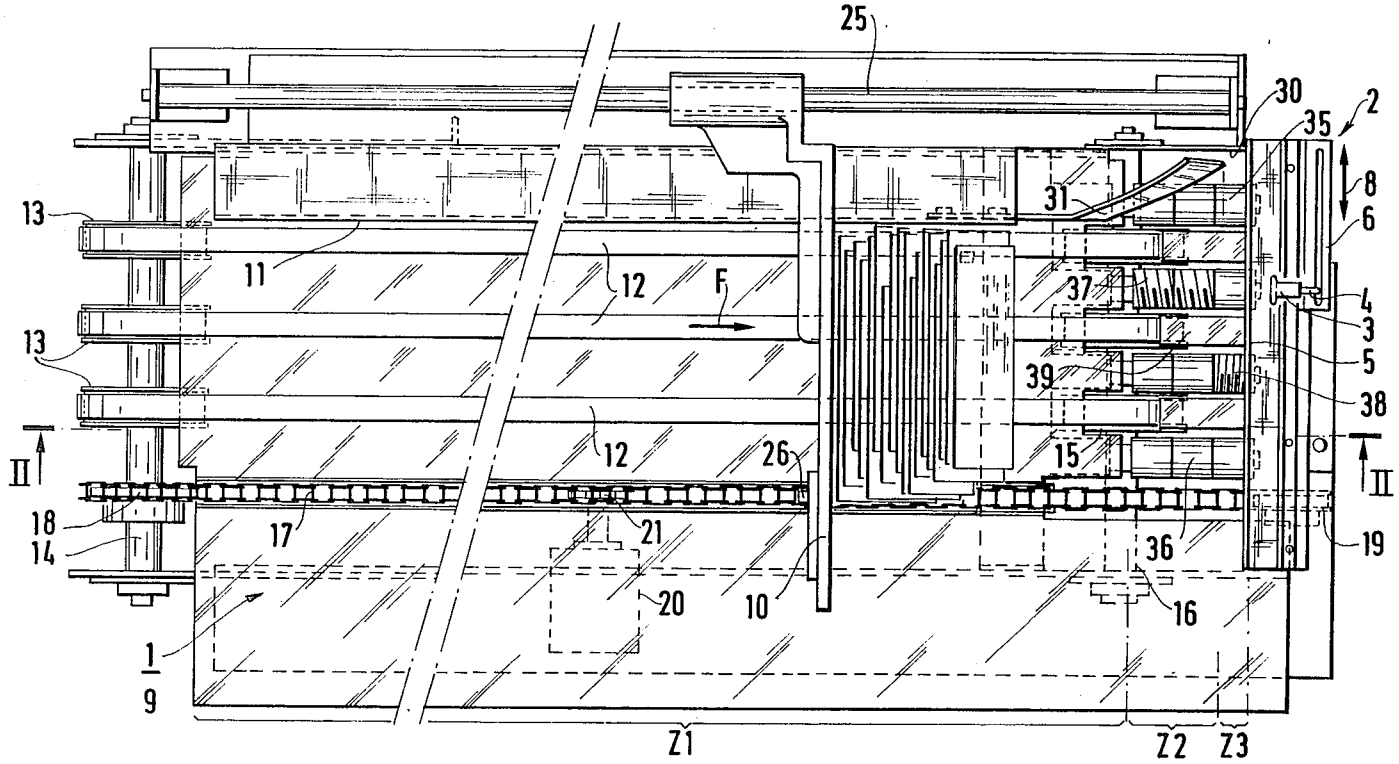
FIG. 1 is a top view of the device in accordance with the invention.

It will be assumed by way of example that the embodiment illustrated in the drawings and described hereinafter is employed in the field of unstacking of mail envelopes.

DETAILED DESCRIPTION OF THE INVENTION

Figure 2:
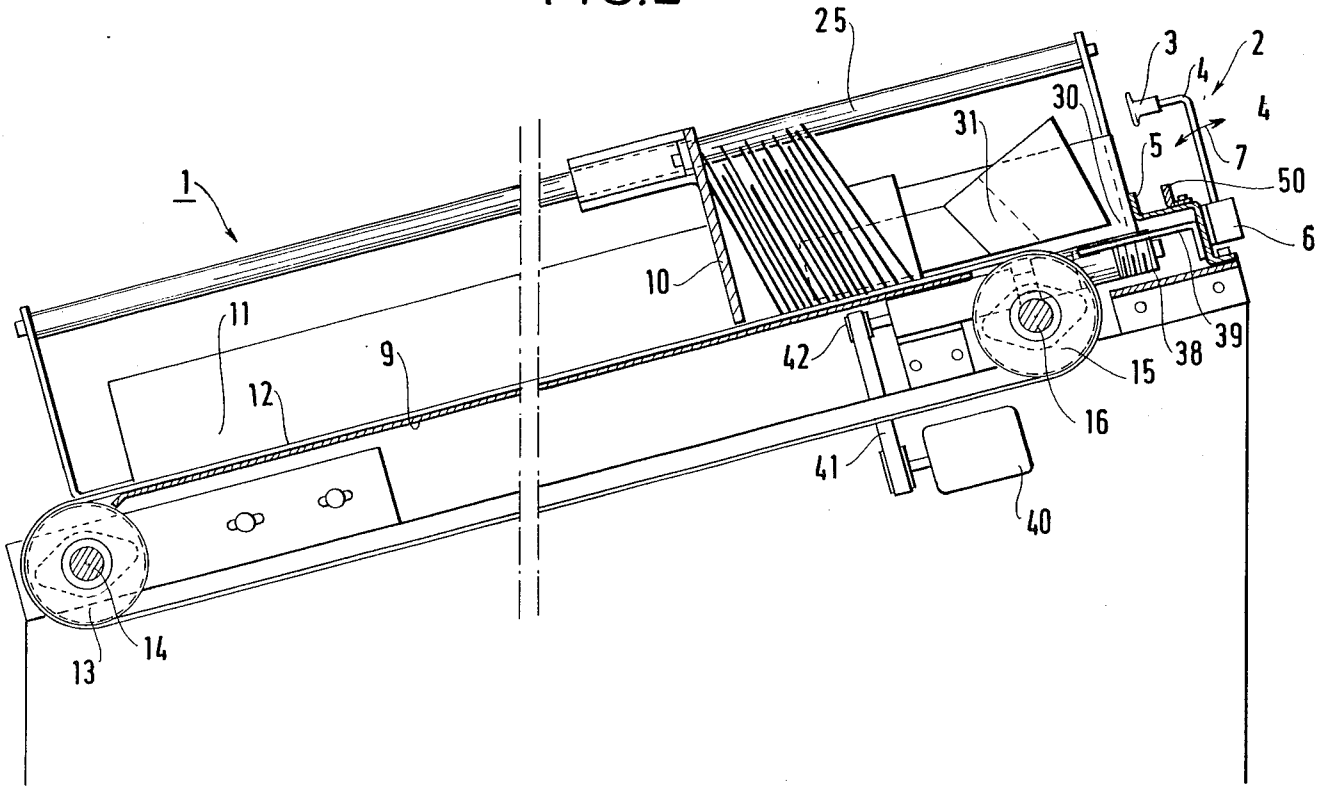
FIG. 2 is a cross-sectional view of the same device, taken along line II—II of FIG. 1.

In FIGS. 1 and 2, it is apparent that the unstacking device includes a magazine 1 for storage of mail envelopes to be unstacked and a discharge head 2 mounted at the end or in front of the magazine.

The discharge head 2 as illustrated in the drawings is of the type comprising a suction cup 3 mounted on an arm 4 which is capable of pivotal displacement in oppositely-facing relation to the end envelope of the stack as well as translational displacement in a lateral direction in front of the stack. An abutment member or stop 5 for the bottom edge of the end envelope of the stack is associated with the suction cup 3. This type of discharge head is already known per se. The head-actuating unit has therefore been simply represented in schematic form at 6 and has the function of driving the suction cup, first in a back-and-forth rocking movement as indicated by the double arrow 7 for the purpose of withdrawing from the stack the end envelope whose bottom edge passes above the abutment member 5, and then in a back-and-forth movement of translation indicated by the double arrow 8 for lateral transfer of the withdrawn end envelope.

Said discharge head is mounted in front of the open front face of the magazine on which is defined the single abutment member or stop 5 for the bottom edge of the end envelope of the stack.

The magazine 1 is of the type which calls for manual loading of a stack of envelopes and is open at least on the top face thereof (not designated by a reference in the drawings). Advantageously, the bottom wall 9 of the magazine is inclined to the horizontal with an upward slope in the forward direction. Provision is made for a stack-retaining back plate 10 located at the rear of the stack. The magazine is intended to receive a random stack of envelopes which are to be discharged, which rest edgewise on the bottom wall of said magazine and which are retained by the back plate. Should it be necessary to retain the stack of envelopes during the loading operation, the magazine is accordingly provided with an internal side wall 11.

The magazine is divided into three zones designated as $Z_1$, $Z_2$, $Z_3$ along its length as considered from the rear end. The zone $Z_1$ corresponds to the greater part of its length and constitutes a so-called feed zone in which stacked envelopes are advanced towards the discharge head. The short-length zone $Z_3$ is the terminal zone in front of the discharge head and constitutes a so-called discharge standby zone. The zone $Z_2$ is an intermediate zone designated as a transition and envelope position resetting zone. As they arrive from the zone $Z_1$, the envelopes received by the intermediate zone $Z_2$ are subjected simultaneously to jogging and resetting in a practically upright position while they pass onwards to the discharge standby zone $Z_3$ for subsequent presentation in front of the discharge head in a position which is as favorable as possible.

In order to carry out the functions mentioned in the foregoing and assigned to the zones $Z_1$, $Z_2$ and $Z_3$ along the magazine, said magazine is differently equipped in each zone.

In the zone $Z_1$, transporting means serve to feed the stack of envelopes in the state in which they have been loaded. These means consist of a set of endless conveyor-belts 12 which are mounted within the bottom wall of the magazine and project slightly above said bottom wall. Said conveyor-belts 12 are stretched between driving pulleys 13 carried by a drive shaft 14 at the rear end of the magazine and idler pulleys 15 carried by a countershaft 16 substantially in the end portion of the feed zone $Z_1$. An endless driving chain 17 extends along the entire length of the zones $Z_1$, $Z_2$ and $Z_3$. This chain is stretched between a sprocket 18 carried by the rear shaft 14 and an idler sprocket 19 mounted at the end of the magazine in front of the countershaft 16. Said driving chain is coupled to a motor 20 by means of a sprocket 21 and transmits power to the conveyor-belts 12 by means of the shaft 14 and the pulleys 13 for advancing stacked envelopes in the state in which they have been loaded. This feed motion is indicated by the arrow F.

The stack-retaining back plate 10 located at the rear of the stack is coupled to the chain 17 and is thus permitted to advance in synchronism with the stack of envelopes.

This back plate is mounted so as to be capable of displacement in sliding motion along a lateral guide 25 on the magazine and is provided with a stud or lug 26 which is adapted to engage between the links of the chain 17. Said stud or lug which projects from the lower portion of the back plate ensures forward motion of this latter in the direction of the arrow F practically to the level of the abutment member 5 at which the chain travels around its idler sprocket 19 beneath the magazine and escapes from said lug. The rearward return of the stack-retaining back plate for subsequent re-loading of the magazine is performed by hand with a slight pivotal displacement of the back plate so as to prevent engagement of its lug in the endless driving chain during this rearward return movement and while the chain is stationary.

In the zone $Z_3$, a jogging edge guide 30 provides the jogging reference of the envelopes with respect to the discharge head. In the zone $Z_2$, another jogging edge guide 31 ensures a transition between the internal side wall 11 of the magazine and the reference edge guide 30. As will be apparent hereinafter, this edge guide is profiled with a view to ensuring in addition that the envelopes which arrive at an excessive angle of slope and are applied against said edge guide are reset in a practically upright position. This in turn ensures optimum presentation of mail envelopes in front of the discharge head as soon as they pass into the discharge standby zone $Z_3$. Said edge guide 31 is affixed to the internal side wall 11 of the magazine and is provided for this purpose with a vertical end portion affixed to the internal side wall 11 in the zone $Z_1$. Said edge guide 31 is then inclined with respect to the direction of forward travel of the envelopes as indicated by the arrow F, essentially along the zone $Z_2$. That end of the edge guide 31 which is located within the zone $Z_2$ is set back with respect to the jogging reference edge guide 30 of the zone $Z_3$ which continues farther towards the exterior and extends rearwardly with respect to the edge guide 31 within the zone $Z_2$. The jogging reference edge guide 30 is vertical.

In the zones $Z_2$ and $Z_3$, there are associated with the edge guides 31 and 30 two jogging rollers 35 and 36 and two screws 37 and 38 which are provided with helical threads of opposite hand from one screw to the next and which are designated as an envelope feed screw and an envelope delay screw.

Figure 3:
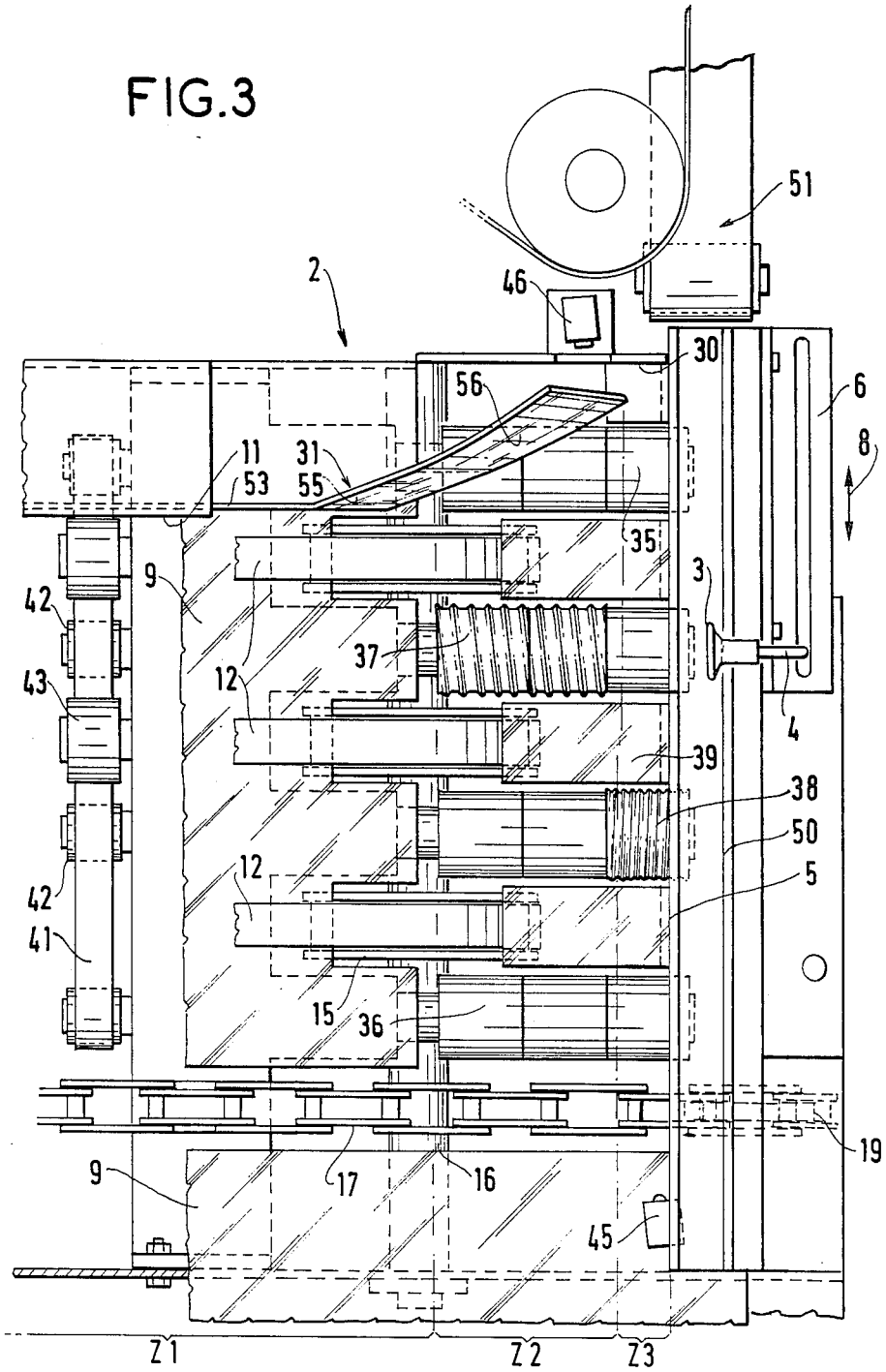
FIG. 3 is a fragmentary top view of the front portion of the device, this view being illustrated to a larger scale than in FIG. 1.

Consideration being given to FIG. 1, FIG. 2 or FIG. 3, it is apparent that these rollers and screws are mounted at the end of the magazine with the screws interposed between the rollers, that their axes are parallel to the envelope feed motion in the direction of the arrow F, that they project beyond the bottom wall 9 of the magazine and the envelope feed means 12 which equip said bottom wall 9, and that they extend to the abutment member 5 while being located in a slightly raised position above the level of the bottom wall 9. A front-end bottom plate 39 is associated with the rollers and screws 35, 36 and 37, 38. This cut-out bottom plate forms an extension of the bottom wall 9 and defines rectangular notches which are inserted in the gaps between rollers and screws.

Sunstantially two-thirds of the rollers and screws considered along their axis are located in the transition and position-resetting zone $Z_2$ whilst their remaining end portion is located in the zone $Z_3$. The innermost jogging roller within the magazine 1 is mounted beneath the jogging edge guide 31. By reason of the inclination of said edge guide 31 with respect to the direction of feed motion of envelopes as indicated by the arrow F, the edge guide 31 extends in a slantwise direction above the roller 35 with its terminal edge receding outwards from the magazine and located in a set-back position with respect to said roller 35.

The threaded screw 37 which follows the roller 35 within the magazine in the transverse direction is the envelope feed screw and is threaded in the zone $Z_2$, that is, substantially over two-thirds of its length. The end portion of the screw which is located in the zone $Z_3$ is smooth and its periphery is placed substantially at the same level as the periphery of the roller 35. Said feed screw 37 is placed substantially opposite to the discharge head 2.

The other threaded screw 38 which follows the roller 35 and the feed screw 37 is the envelope delay screw. This latter is threaded only in the end portion which is located in the zone $Z_3$ and at the very end of the zone $Z_2$. The main portion of said screw 38 which belongs to the zone $Z_2$ and corresponds substantially to one-third of its length has a smooth surface, a periphery which is located at the same level as the jogging rollers and contributes to the jogging operation.

The second jogging roller 36 extends between the driving chain 17 and the delay screw 38, substantially on the outer side of the magazine.

The two jogging rollers 35 and 36 and the two feed and delay screws 37 and 38 are driven in rotation from a common reduction-gear motor 40. A flat driving belt 41 and pulleys 42 together with associated tensioning devices 43 have the function of driving said jogging rollers.

The speed of rotation of the rollers and screws is chosen so as to obtain a linear feed rate in zone $Z_2$ which is higher than that produced by the driving belts in zone $Z_1$ and a linear delay rate in zone $Z_3$ of the same order of magnitude as in zone $Z_1$.

At the front end of the magazine, as shown in FIG. 3, a photoelectric cell 45 and an associated lamp 46 ensure detection of envelopes in the discharge standby zone $Z_3$. The lamp 46 is mounted above the jogging edge guide 30 of the zone $Z_3$ practically at the end of the edge guide 31 whilst the photoelectric cell is mounted on the opposite side substantially at the end of the abutment member 5, thus defining an axis of detection of mail envelopes which pass slantwise across the zone $Z_3$. When the beam produced by the lamp is interrupted and is accordingly not received by the photoelectric cell, in particular when envelopes are present within the zone $Z_3$, said cell initiates stopping of the envelope-feed motor 20. On the contrary, when no beam interruption takes place, the photoelectric cell initiates startup of the motor. It also serves to initiate stopping of the motor when the magazine is completely empty after a stack discharge operation since, under these conditions, the stack-retaining back plate has arrived within the zone $Z_3$ and thus interrupts the beam produced by the lamp 46.

In addition, provision is made in front of the magazine for a second abutment member 50 which is located in front of the abutment member 5 and defines with this latter a trough for receiving the envelope which has been taken by the suction cup 3 and for guiding said envelope during its translational movement of transfer by the suction cup. The envelope which is thus transferred by the suction cup in a movement of translation in the direction of the arrow 8 between the abutment members 5 and 50 is then taken over by a conveyor-belt system generally designated by the reference numeral 51 for discharge of said envelope and any subsequent processing operation.

Figure 4:
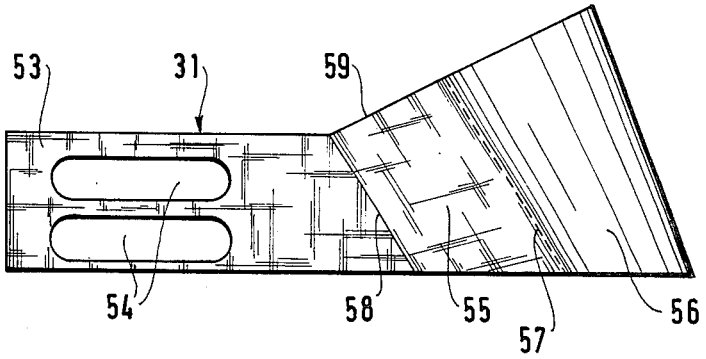
FIGS. 4 and 5 are respectively a front view and a top view showing one of the elements of the device in accordance with the invention.
Figure 5:
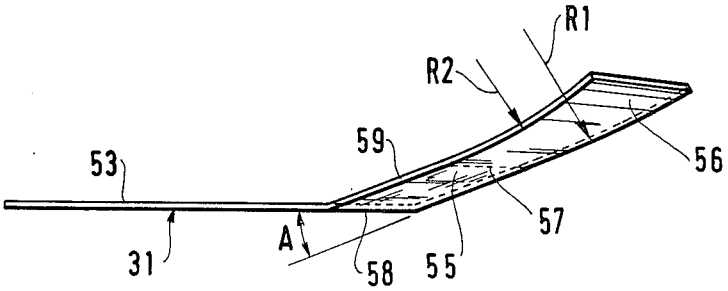

FIGS. 4 and 5 are respectively a front view and an overhead view in which the transition and position-resetting guide 31 is illustrated separately and to a larger scale. If reference is also made to FIG. 1 while consideration is given to FIGS. 4 and 5, it is apparent that the edge guide 31 is provided in the first place with a vertical terminal lug 53 for attaching the edge guide to the internal side wall 11 of the magazine. Elongated horizontal slots 54 formed in said lug 53 serve to adjust the position-location of the edge guide at the end of the internal side wall of the magazine. The edge guide 31 proper is understood to extend beyond the attachment lug 53 and is inclined with respect to said attachment lug so as to extend upwards towards the exterior of the magazine in an outwardly curved shape or flareout. More specifically, said inclined portion consists of a flat portion 55 which is adjacent to the vertical attachment lug and of a second curved portion 56 having substantially a frusto-conical surface. The flat portion 55 forms with the attachment lug 53 a skew ridge 58 formed by bending on that face of the edge guide 31 which is directed towards the interior of the magazine. The bending angle designated as A is advantageously chosen so as to have a value of the order of 20 degrees and determines the inclination of the edge guide with respect to the feed motion of the mail envelopes in the direction of the arrow F. The bottom edge of said flat portion 55 is parallel to the bottom wall of the magazine whilst the top edge 59 of said flat portion is inclined so as to flare-out the edge guide towards the front end of the magazine.

The curved portion 56 forms an extension of the flat portion 55 without any really apparent transition with this latter. This transition is represented schematically by the dashed line 57. Said curved portion 56 is produced by preforming and then burnishing with said flat portion 55.

The radius of curvature of the bottom edge of said curved portion is substantially double that of its top edge in order to increase the inclination, towards the exterior of the magazine, of the top edge of said curved portion with respect to the inclination of its bottom edge and thus to reduce in height even the small sliding effort of the envelopes on this terminal portion of the edge guide 31. The radii of curvature R1 and R2 of the top and bottom arrises which are tangent to the line 57 have been noted in FIG. 5.

Advantageously, that face of said edge guide 31 which is internal to the magazine is covered with an anti-adhesive coating or film (not shown) such as a polyvinyl chloride film.

As a complement to the foregoing description of the unstacking device, the values of parameters selected by way of preference are given hereinafter:

inclination of the bottom wall of the magazine with respect to the horizontal: 10° inclination of the back plate with respect to a line perpendicular to the bottom wall of the magazine: 7° feed rate of conveyor-belts and driving chain: 15 mm/s thread pitch of feed screw: 7 mm thread pitch of delay screw: 3.5 mm speed of rotation of rollers and screws: 250 rpm, at which value the linear velocity transmitted by the feed screw is in the vicinity of 30 mm/s and the linear velocity produced by the delay screw is 15 mm/s.

During operation, the feed motion of the mail envelopes in the state in which they have been loaded is carried out in the direction of the arrow F by the conveyor-belts 12. As soon as the first envelopes arrive in the zone $Z_2$, they are subjected to the action of the light transverse force exerted on their bottom edges by frictional engagement with jogging rollers for alignment of the envelopes by jogging against the inclined flat portion of the edge guide 31 and are subjected simultaneously to the feed action exerted on their bottom edges by the feed screw. The linear feed rate of the envelopes within the zone $Z_2$, the value of which has been chosen so as to exceed that rate of feed within the zone $Z_1$, has the effect of releasing these envelopes from the stack and permitting effective action of the jogging rollers.

This action of jogging of the first envelopes which are placed against each other without any application of pressure as they advance within the zone $Z_2$ in conjunction with the curved profile of the terminal portion 56 of the jogging edge guide 31 have the effect of resetting excessively inclined envelopes in a practically upright position in which they are abuttingly applied against said edge guide 31.

At the end of the zone $Z_2$, angular resetting of mail envelopes which are still being applied by jogging against the edge guide 31 is further assisted by the additional action of the threads of the delay screw which, in conjunction with the action of the feed screw, has the effect of imparting a movement of pivotal displacement to the bottom edges of the envelopes. Thus the mail envelopes which are successively reset in a practically upright position and not subjected to any pressure are transferred to the discharge standby zone in which they are presented in front of the discharge head at an optimum angle of slope corresponding substantially to 7 degrees.

In this discharge standby zone $Z_3$, the jogging rollers and the smooth portion of the feed screw maintain the envelopes against the jogging reference edge guide. The delay screw 31 continues its action on the mail envelopes and has the effect of setting the end envelope in a slantwise position at an angle of a few degrees with respect to the abutment member 5 in order to guard against any danger of compression of envelopes in this discharge standby zone $Z_3$ and any possible thrust which would be liable to result in adhesion of the end envelope against the suction cup in the rest position.

The present invention has been described in connection with the constructional assembly which is illustrated in the accompanying drawings. As will readily be understood, however, it would be possible to contemplate detail modifications and/or to replace certain means by other technically equivalent arrangements without thereby departing either from the scope or the spirit of the invention. It is further apparent that the values of the parameters indicated earlier have been given only in relation to each other and are concerned solely with a preferential embodiment of the device in accordance with the invention.

What is claimed is:

1. A device for unstacking flat objects, comprising a magazine for receiving stacked objects, a discharge head located at the end of the magazine, feed means for advancing said stacked objects in the magazine towards the discharge head, and further comprising in the terminal portion of the magazine opposite to the discharge head a lateral edge guide and associated rollers for jogging objects and means for separating said objects which are present in front of the discharge head, wherein said jogging edge guide considered from the upstream end to the downstream end on said terminal portion of the magazine is constituted by a first edge guide designated as a transition and object-position resetting edge guide which is placed in an inclined position with respect to the direction of feed motion of said objects towards said discharge head and by a second edge guide which provides a jogging reference with respect to the discharge head and is substantially parallel to the direction of feed motion of the objects towards said head, said jogging reference edge guide being relatively displaced towards the exterior of the magazine with respect to said transition and position-resetting edge guide.

2. A device according to claim 1, wherein said separating means include a feed screw for advancing objects, said feed screw being located between the jogging rollers and downstream of the aforesaid feed means for advancing said objects towards the discharge head, the axis of said feed screw being substantially parallel to the axes of the rollers and to the direction of feed motion of said objects towards said discharge head, said feed screw being mounted substantially opposite to said discharge head and having the function of imparting to said objects while jogging is in progress a linear velocity of higher value than that of said feed means for advancing stacked objects.

3. A device according to claim 2, wherein said separating means further include a delay screw for retarding objects, said delay screw being interposed with the aforesaid feed screw between the jogging rollers and being substantially parallel to said feed screw, said delay screw being located at a greater distance from the aforesaid transition and position-resetting edge guide and jogging reference edge guide than said feed screw and having the function of imparting to said objects an opposite linear velocity of substantially the same value as that of said feed means for advancing stacked objects.

4. A device according to claim 3, wherein the aforesaid feed screw and delay screw are threaded along only a portion of their length in the aforesaid terminal zone of the magazine in which said screws define one after the other a second zone located downstream of a first stacked-envelope feed zone in which the aforesaid stacked-object feed means are located, said second zone being designated as a transition and position-resetting zone in which are substantially located the threaded feed portion of the feed screw, the aforesaid transition and position-resetting edge guide, the non-threaded portion of the delay screw and the corresponding portion of the jogging rollers, and a third zone designated as a discharge standby zone in which are substantially located the threaded portion of the delay screw, said reference jogging edge guide, the non-threaded portion of the feed screw and the corresponding second portion of the jogging rollers.

5. A device according to claim 4, wherein the non-threaded portions of the screws constitute in the zones to which they belong jogging portions which are substantially identical with the jogging rollers.

6. A device according to claim 1, wherein the aforesaid transition and position-resetting edge guide is profiled so as to have an increasing inclination in the downstream direction in the aforesaid terminal zone of the magazine with respect to the direction of feed motion of the aforesaid stacked objects.

7. A device according to claim 6, wherein the top edge of the downstream terminal portion of the aforesaid transition and position-resetting edge guide is more steeply inclined than its bottom edge.

8. A device according to claim 6, wherein the aforesaid transition edge guide extends beyond the aforesaid terminal zone of the magazine opposite to the aforesaid discharge head and has a skew ridge formed by bending on an attachment lug which is substantially parallel to the direction of feed motion of the aforesaid stacked objects.

9. A device according to claim 8, wherein the aforesaid attachment lug is provided with elongated slots for adjusting the position-location of the transition and position-resetting edge guide with respect to the aforesaid terminal portion of the magazine.

10. A device according to claim 1, wherein said device includes a photoelectric cell for detecting objects and an associated lamp mounted on each side of the aforesaid terminal portion in order to sweep in a slantwise direction the end of the terminal portion which is limited on one side by the aforesaid jogging reference edge guide and in order to control the aforesaid feed means for advancing stacked objects.

* * * * *